US008438719B2

(12) United States Patent
Kim et al.

(10) Patent No.: US 8,438,719 B2
(45) Date of Patent: May 14, 2013

(54) METHOD FOR MANUFACTURING ANTENNA

(75) Inventors: Hyun Hak Kim, Gyunggi-Do (KR); Joong Han Yoon, Gyunggi-Do (KR); Jae Chan Lee, Gyunggi-Do (KR); Gi Ho Han, Gyunggi-Do (KR); Dong Hyun Kim, Gyunggi-Do (KR); Seok Min Woo, Gyunggi-Do (KR)

(73) Assignee: Samsung Electro-Mechanics Co., Ltd. (KR)

( * ) Notice: Subject to any disclaimer, the term of this patent is extended or adjusted under 35 U.S.C. 154(b) by 712 days.

(21) Appl. No.: 12/188,963

(22) Filed: Aug. 8, 2008

(65) Prior Publication Data

US 2009/0038141 A1 Feb. 12, 2009

(30) Foreign Application Priority Data

Aug. 9, 2007 (KR) ..... 10-2007-0080142

(51) Int. Cl.
*H01P 11/00* (2006.01)

(52) U.S. Cl.
USPC ..... 29/600; 29/601; 264/278; 343/796; 343/895

(58) Field of Classification Search ..... 29/600, 29/601, DIG. 29, 605, 606; 264/136, 272.11, 264/272.19, 272.2, 278; 343/795, 796, 895; 523/209
See application file for complete search history.

(56) References Cited

U.S. PATENT DOCUMENTS

| | | | | | |
|---|---|---|---|---|---|
| 3,616,181 | A * | 10/1971 | Stalego | ..... | 264/136 X |
| 3,764,456 | A * | 10/1973 | Woodhams | ..... | 523/209 |
| 4,193,185 | A * | 3/1980 | Liautaud | ..... | 29/605 |
| 4,681,718 | A | 7/1987 | Oldham | | |
| 6,338,812 | B1 * | 1/2002 | Ogura | ..... | 264/278 X |
| 6,922,178 | B2 * | 7/2005 | Sutter et al. | ..... | 343/895 |
| 2004/0244187 | A1 | 12/2004 | Annamaa et al. | | |

FOREIGN PATENT DOCUMENTS

| | | | | | |
|---|---|---|---|---|---|
| DE | 10340539 | A1 | | 3/2005 | |
| EP | 0470396 | A2 | | 2/1992 | |
| JP | 05167320 | A | * | 7/1993 | ..... 29/600 |
| JP | 2000238162 | A | * | 9/2000 | |
| KR | 2001-0106475 | A | | 11/2001 | |
| KR | 20060094323 | | | 3/2008 | |
| WO | 2005023920 | A1 | | 3/2005 | |

OTHER PUBLICATIONS

German Office Action for application No. 10 2008 036 556.4-16, issued Jan. 11, 2011.
Chinese Office Action for Application No. 200810133385.3 mailed Jun. 15, 2011.

* cited by examiner

*Primary Examiner* — A. Dexter Tugbang
(74) *Attorney, Agent, or Firm* — Lowe Hauptman Ham & Berner, LLP

(57) ABSTRACT

Provided is a method for manufacturing an antenna which is minimized and used in a low frequency band. The method includes forming and preparing a radiator for an antenna, mounting the radiator inside a dam molding part including an upper dam molding part and a lower dam molding part, injecting a molding material into the dam molding part through an inlet provided at one side of the dam molding part, the molding material including a composite material with a controlled diameter and content, hardening the injected molding material, and separating the hardened molding material covering the radiator from the dam molding part. Accordingly, a miniaturized antenna can be provided, which can achieve a high integration density, prevent deformation of the radiator caused by external pressure generated in processes, and be used in a low frequency band by covering the radiator with a molding material having a high permittivity and a low-loss characteristic.

8 Claims, 5 Drawing Sheets

METHOD FOR MANUFACTURING ANTENNA

CROSS-REFERENCE TO RELATED APPLICATIONS

This application claims the priority of Korean Patent Application No. 2007-80142 filed on Aug. 9, 2007, in the Korean Intellectual Property Office, the disclosure of which is incorporated herein by reference.

BACKGROUND OF THE INVENTION

1. Field of the Invention

The present invention relates to a method for manufacturing an antenna, and more particularly, to a method for manufacturing an antenna, capable of manufacturing a miniaturized antenna being used in a low frequency band.

2. Description of the Related Art

The recent diversification of mobile communication terminals has led to the release of broadcasting-communication convergence products. Thus, the development of multiplexed, miniaturized and built-in antennas is ongoing. An antenna used for communication performs transmission/reception in a frequency band of 800 MHz to 6000 MHz, and has a size that is small enough to be mounted inside a terminal. However, for broadcasting, the mobile communication terminal currently uses a relatively low frequency band as compared to a frequency for communication. For this reason, it is relatively difficult to mount the antenna within a product. Particularly, in order for the mobile communication terminal to receive a low frequency band of about 86 MHz, even in the case of a $\lambda/4$ antenna, the antenna must have a size of at least 85 cm to 90 cm, a size of about 40 cm for a very high frequency (VHF) band, and about 15 cm for an ultra high frequency (UHF) band.

A communication antenna among related art miniaturized antennas is manufactured by injecting a material having a permittivity, or by printing a metallic conductor on a polymer material or a ceramic block having a high permittivity and performing plating thereon. Miniaturized antennas for connectivity are manufactured by stacking ceramic sheets or inserting a conductor in a polymer having a permittivity.

In another method for manufacturing a miniaturized antenna, a composite material which is a mixture of a polymer material for injection and dielectric powder having a high permittivity, i.e., high-k dielectric powder, is injected so as to insert a conductor to a polymer. However, 40 wt % or more of the dielectric power cannot be mixed with the polymer because of the injection process. Thus, there is a limitation in preparing a high-k material.

The composite material for injection developed for a general antenna radiator has a relative permittivity of 20 or less. For this reason, there is a limitation in using the related art composite material for a miniaturized antenna which can be mounted inside a terminal for a UHF band or a lower frequency band.

The high-k composite material used for a related art antenna is developed in order to prevent thermal deformation of high-k ceramics prepared by a thermal treatment, enhance mechanical strength of the ceramics, improve reproducibility of products, and shorten the process time by omitting a thermal treatment process in a manufacturing process. However, when a composite material having a sufficiently high permittivity to miniaturize an antenna is developed, a limitation of a compounding process having the injection process is not overcome. Thus, it is difficult to develop a composite material having a relative permittivity of 30 or higher.

SUMMARY OF THE INVENTION

An aspect of the present invention provides a method for manufacturing an antenna, capable of manufacturing a miniaturized antenna mounted inside a mobile communication terminal and having a high relative permittivity to be used in an UHF band or a lower frequency band.

According to an aspect of the present invention, there is provided a method for manufacturing an antenna including: forming and preparing a radiator for an antenna; mounting the radiator inside a dam molding part including an upper dam molding part and a lower dam molding part; injecting a molding material into the dam molding part through an inlet provided at one side of the dam molding part, the molding material including a composite material with a controlled diameter and content; hardening the injected molding material; and separating the hardened molding material covering the radiator from the dam molding part.

The radiator for an antenna may be one of a helical radiator, a monopole, a dipole, a planar inverted-F antenna (PIFA), a meander line, a loop radiator and a fractal radiator.

The mounting the radiator inside a dam molding part may include: drawing one end of the radiator out from the inlet of the upper dam molding part, inserting the other end of the radiator in a leakage preventing member and mounting the other end of the radiator to the lower dam molding part; and coupling the upper dam molding part with the lower dam molding part to form the dam molding part in which the radiator is mounted at a central portion.

The mounting the radiator inside a dam molding part may further include: applying a release agent to an upper inner groove of the upper dam molding part and a lower inner groove of the lower dam molding part corresponding to the upper inner groove.

In the injecting a molding material into the dam molding part, the molding material may be a material having a relative permittivity ranging from approximately 20 to approximately 60. The composite material may include one of $BaO—TiO_2$, $(Mg, Ca)TiO_3$, $BaO—Nd_2O_3—TiO_2$, $Ba(Mg, Ta)O_3$, $Ba(Zn, Ta)O_3$ and $(Zr, Sn)TiO_4$, which is mixed at a content ranging from approximately 40 wt % to approximately 90 wt % with respect to a polymer material selected from the group consisting of epoxy, acetyl, polystyrol, polyester and polyethylene.

The composite material may have a diameter ranging from approximately 5 μm to approximately 20 μm.

The molding material may include a solvent and a metallic component selected from the group consisting of Mg, Zn, Ni, Co, Mn and Ca.

The hardening the injected molding material may include performing a heat-treatment at a temperature ranging from approximately 25° C. to approximately 200° C. by using a predetermined heating chamber or an ultraviolet ray.

In the mounting the radiator inside a dam molding part, the upper dam molding part may include an upper inner groove, the inlet penetrating outward from one side of the upper inner groove, and two upper mounting grooves respectively provided at edges of the upper dam molding part such that both ends of the radiator are mounted thereto, respectively drawn out from the upper mounting grooves. The lower dam molding part may include a lower inner groove corresponding to the upper inner groove, and two lower mounting grooves respectively corresponding to the two upper mounting grooves. The upper mounting grooves and the lower mounting grooves may interlock both ends of the radiator so that the radiator is mounted at a center in the dam molding part.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
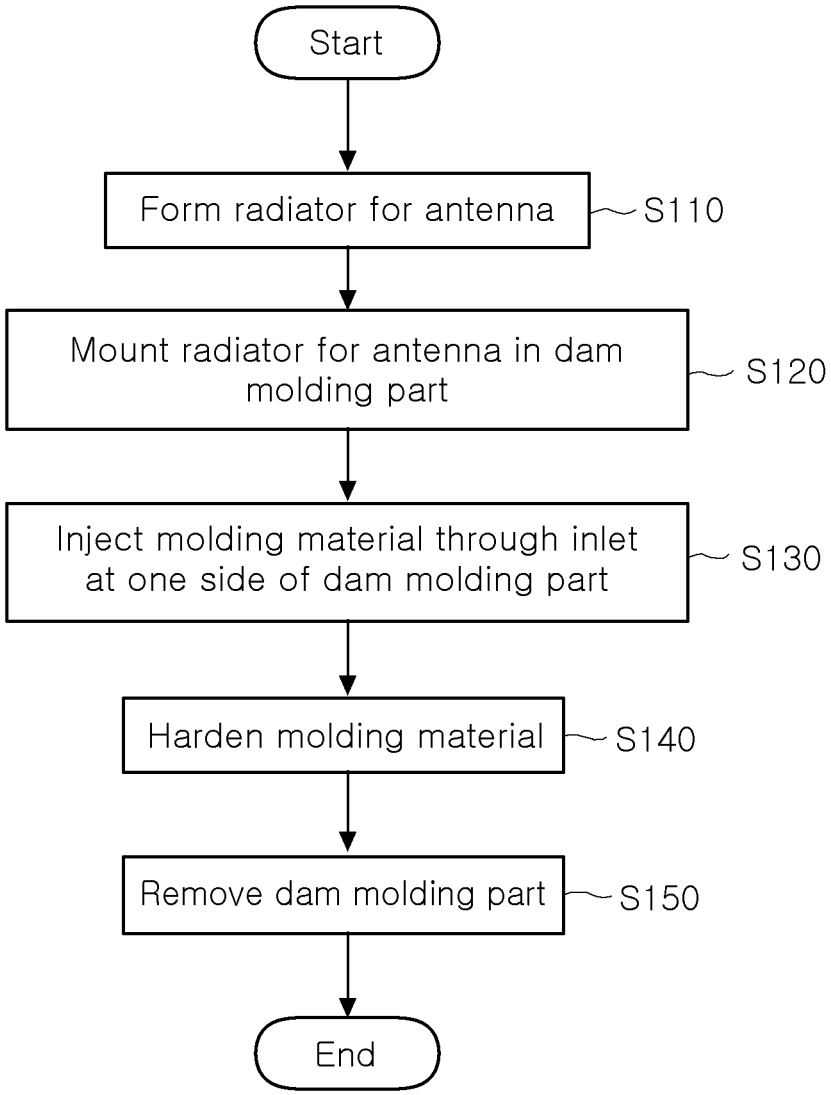
FIG. 1 is a flowchart for explaining a method for manufacturing a miniaturized antenna according to an exemplary embodiment of the present invention.
Figure 2A:
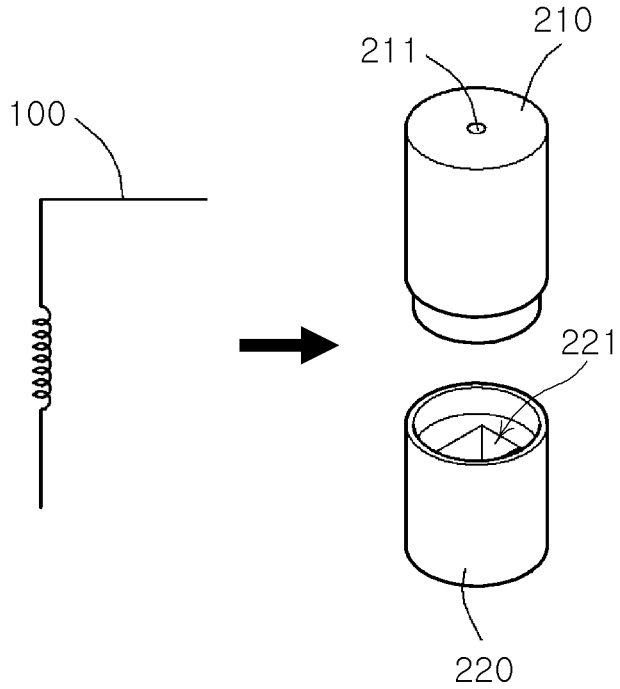
FIGS. 2A through 2C are perspective views for explaining the method for manufacturing a miniaturized antenna according to the exemplary embodiment of the present invention.
Figure 2B:
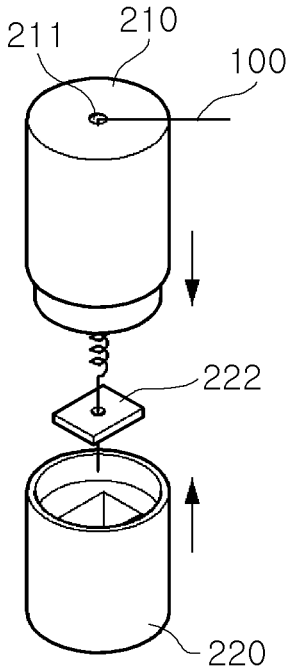
Figure 2C:
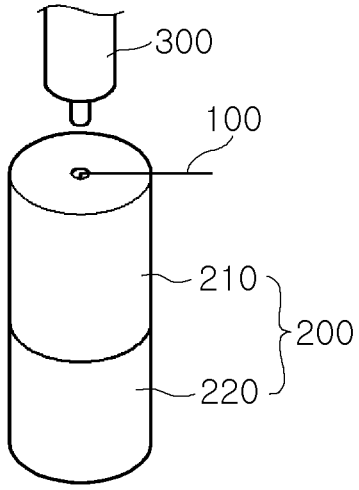

FIG. 1 is a flowchart for explaining a method for manufacturing a miniaturized antenna according to an exemplary embodiment of the present invention. FIGS. 2A through 2C are perspective views for explaining the method for manufacturing a miniaturized antenna according to the exemplary embodiment of the present invention.

The present invention implements a radiator having a high integration density required in a miniaturized structure by using a high-k molding material and a dam molding part in order to manufacture a miniaturized antenna that can be mounted inside a mobile communication terminal. The present invention also implements a method for manufacturing a miniaturized antenna coated with a molding material stably without deformation of a radiator by minimizing external pressure generated during processes.

In the method for manufacturing a miniaturized antenna according to an exemplary embodiment of the present invention, as shown in FIG. 1, a radiator constituting an antenna is formed and prepared in operation S110.

As an example of the radiator constituting the antenna, referring to FIG. 2A, a radiator 100 having a helical structure may be formed by an injection process. However, examples of the radiator may include, besides the helical radiator 100, a monopole, a dipole, a planar inverted-F antenna (PIFA), a meander line, a loop radiator and a fractal radiator.

After the radiator 100 constituting the antenna is prepared, the radiator 100 is mounted inside a dam molding part 200 formed of ceramics or metal in operation S120.

Specifically, the radiator 100 of FIG. 2A is mounted within the hollow dam molding part 200 including an upper dam molding part 210 and a lower dam molding part 220. As shown in FIG. 2B, one end of the radiator 100 is drawn out from an inlet 211 of the upper dam molding part 210. The other end of the radiator 100 is mounted within the lower dam molding part 220, inserted in a hole of a leakage preventing member 222 for preventing a molding material, which will be injected later, from leaking to a lower side of the lower dam molding part 220.

The leakage preventing member 222 is mounted to an inner space 221 of the lower dam molding part 220 by step-coupling. Thereafter, the upper dam molding part 210 and the lower dam molding part 220 are coupled together by screw-coupling or step-coupling, thereby forming the dam molding part 200 having a capsule-like shape. In such a manner, the radiator 10 is mounted inside the dam molding part 200.

Before the radiator 100 is mounted inside the dam molding part 200, a release agent such as silicon oil is applied on an inner surface of the upper dam molding part 210 and an inner surface of the lower dam molding part 220. Accordingly, after the molding material is hardened, the dam molding part 200 can be easily separated from the hardened molding material.

After the radiator 100 is mounted inside the dam molding part 200, the molding material is injected through the inlet 211 provided at one side of the dam molding part 200 in operation S130.

As shown in FIG. 2B, the upper dam molding part 210 is coupled with the lower dam molding part 220, and thus as shown in FIG. 2C, the dam molding part 200 encapsulating the radiator 100 is formed. Then, the molding material can be injected through the inlet 211 of the upper dam molding part 210 from which one end of the radiator 100 is drawn out. Of course, an inlet for injection of the molding material may be formed at one side of the dam molding part for the convenience of a process, besides the inlet 211 of the upper dam molding part 210.

The molding material is a material that may have a relative permittivity ranging from 20 to 60. As the molding material, a molding material may be used, in which the composite material including a ceramic component such as $BaO—TiO_2$, $(Mg, Ca)TiO_3$, $BaO—Nd_2O_3—TiO_2$, $Ba(Mg, Ta)O_3$, $Ba(Zn, Ta)O_3$, and $(Zr, Sn)TiO_4$ is mixed with a diameter of approximately 5 μm to approximately 20 μm at a content of approximately 40 wt % to approximately 90 wt % with respect to a polymer material such as epoxy, acetyl, polystyrol, polyester and polyethylene having a low temperature coefficient to be advantageous to injection molding or filling/curing.

When the composite material of the molding material is mixed at a content of 80 wt % or higher, a solvent may be added to the molding material so that the molding material can be smoothly injected, i.e., the viscosity of the molding material can be decreased. The relative permittivity of the molding material can be set by controlling the diameter and content of the composite material.

To control the selectivity (Q) of an antenna, a small amount of metallic component such as Mg, Zn, Ni, Co, Mn and Ca may be added to the molding material.

The molding material having the aforementioned composition is injected from a nozzle 300 through the inlet 211 at a sufficient rate not to cause deformation of the radiator 100. Thus, the radiator 100 encapsulated in the dam molding part 200 is impregnated with the molding material. A thermal treatment is performed on the dam molding part 200 including the molding material with which the radiator 100 is impregnated, thereby hardening the molding material in operation S140.

In the thermal treatment for hardening the molding material, the molding material is heated in a predetermined heating chamber or by using an ultraviolet ray at a temperature ranging from about 25° C. to about 200° C. for few seconds to few minutes. In such a manner, the molding material can be hardened.

After the molding material is hardened through the thermal treatment, the hardened molding material with which the radiator 100 is impregnated is then separated from the dam molding part 200. Thus, the dam molding part 200 is removed to complete an antenna in operation S150.

To remove the dam molding part 200, the step-coupling or the screw-coupling between the upper dam molding part 210 and the lower dam molding part 220 is released. The separation therebetween can be facilitated by the release agent such as silicon oil applied to the inner surfaces of the upper dam molding part 210 and the lower dam molding part 220 in the previous operation.

An antenna including a radiator covered with a molding material having a high permittivity and a low loss characteristic is manufactured so that a high integration density required in a miniaturized antenna can be achieved, and deformation of the radiator caused by external pressure generated during processes can be prevented.

A method for manufacturing an antenna using another dam molding part according to another exemplary embodiment of the present invention will now be described with reference to FIGS. 3A and 3B.

Figure 3A:
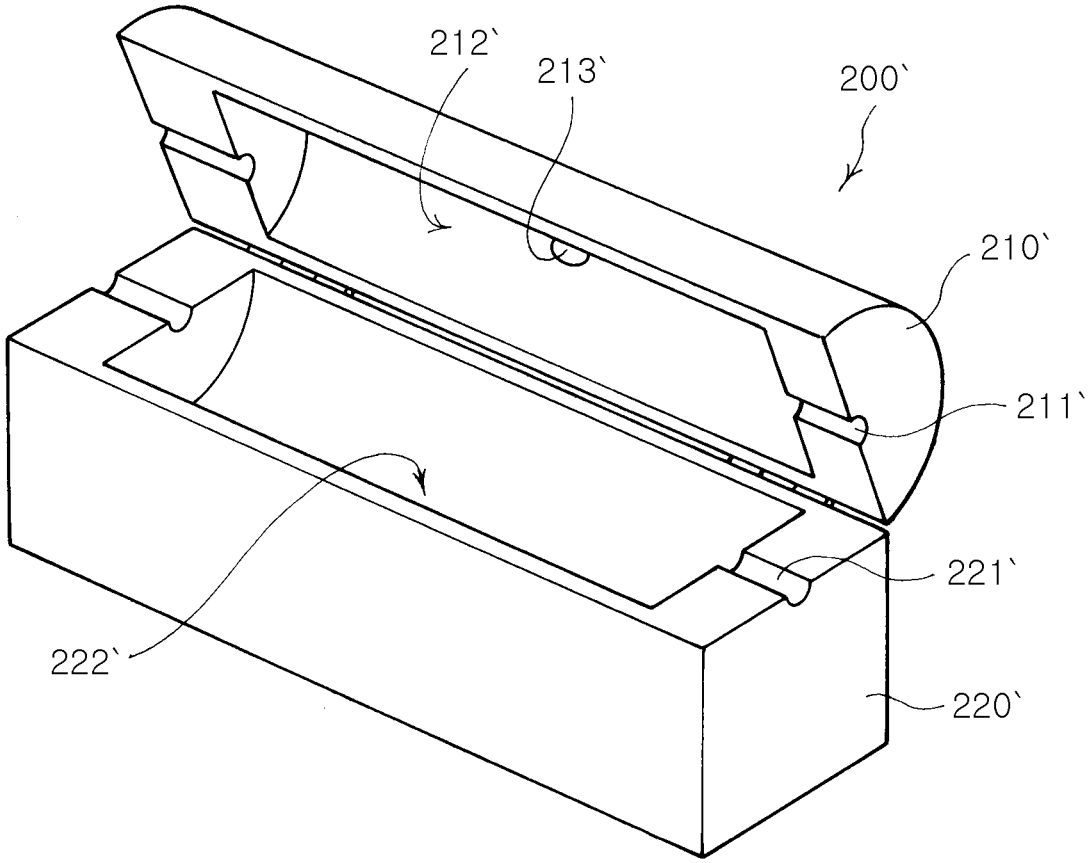
FIG. 3A is a perspective view of a dam molding part according to another exemplary embodiment of the present invention.

FIG. 3A is a perspective view of another dam molding part according to another exemplary embodiment of the present invention. FIG. 3B is an exemplary view for explaining a method for manufacturing an antenna using another dam molding part according to another exemplary embodiment of the present invention.

Figure 3B:
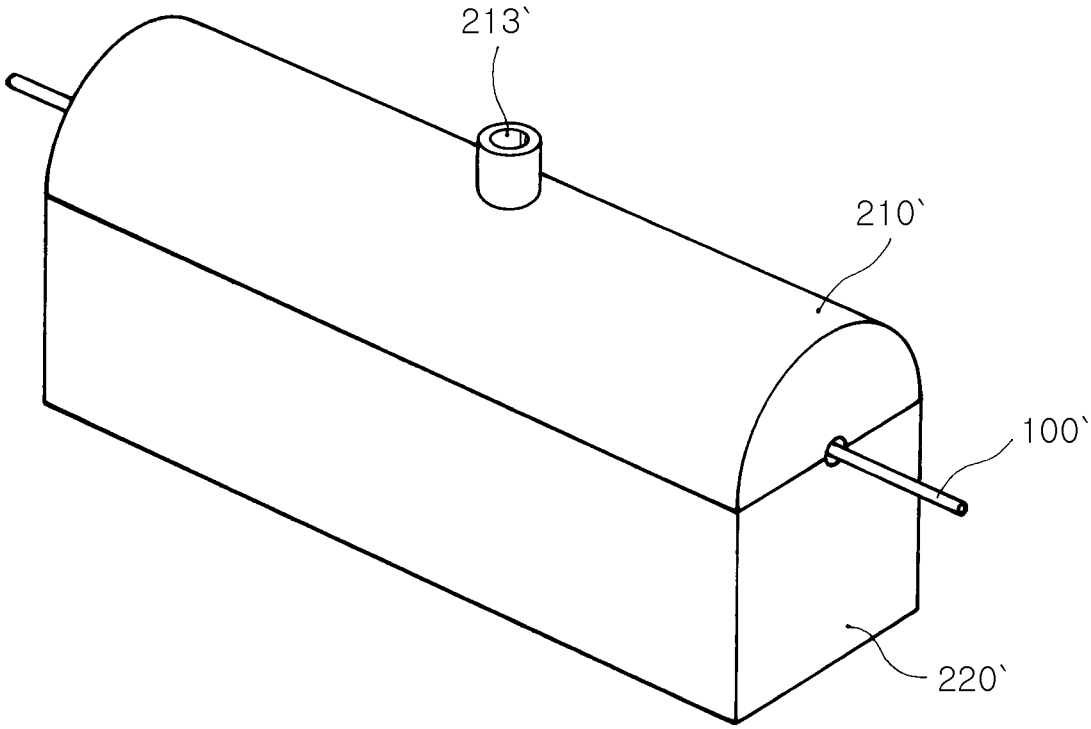
FIG. 3B is an exemplary view for explaining a method for manufacturing an antenna using the dam molding part of FIG. 3A.

Another exemplary embodiment of FIGS. 3A and 3B is similar to the previous exemplary embodiment of FIGS. 2A and 2B. Thus, a detailed description of the similar part will be omitted. A process of manufacturing an antenna using another dam molding part 200' will now be described.

Referring to FIG. 3A, the dam molding part 200' according to another exemplary embodiment of the present invention is formed of ceramics or metal, and includes an upper dam molding part 210' and a lower dam molding part 220'. The upper dam molding part 210' is connected with the lower dam molding part 220' by a coupling member such as a hinge provided at a side face, thereby forming an inner space. Of course, the scale of the dam molding part 200' can be minimized according to the desired scale of an antenna.

For example, the dam molding part 210' includes an upper inner groove 212' having a semicircular cylindrical shape, an inlet 213' penetrating outwardly from one side of the upper inner groove 212', and upper mounting grooves 211' through which both ends of a radiator 100' are drawn out.

The lower dam molding part 220' includes a lower inner groove 222' having a semicircular cylindrical shape corresponding to the upper inner groove 212', and lower mounting grooves 221' corresponding to the upper mounting grooves 211'. Thus, the lower mounting grooves 221' and the upper mounting grooves 210' interlock both ends of the radiator 100', so that the radiator 100' can be mounted at the center inside the dam molding part 200'.

As shown in FIG. 3B, the dam molding part 200' encapsulating the radiator 100' at its center is formed by coupling the upper dam molding part 210' with the lower dam molding part 220'. The molding material is injected through the inlet 213' of the upper dam molding part 210' at a sufficient rate not to cause deformation of the radiator 100'. Thus, the radiator 100' encapsulated in the dam molding part 200' is impregnated with the molding material without being deformed. A thermal treatment is performed on the dam molding part 200' including the molding material with which the radiator 100' is impregnated, thereby hardening the molding material.

By using the dam molding part 200' having the above structure according to the current exemplary embodiment, the molding material is injected without leaking, without the leakage preventing member 222. Thus, the separation can be facilitated.

Accordingly, an antenna including a radiator covered with a molding material having a high permittivity and a low-loss characteristic can be manufactured by using the dam molding part 200 or 200' according to the exemplary embodiments of the present invention, so that the antenna can achieve a high integration density required in a miniaturized antenna and prevent deformation of the radiator caused by external pressure generated during processes.

Figure 4:
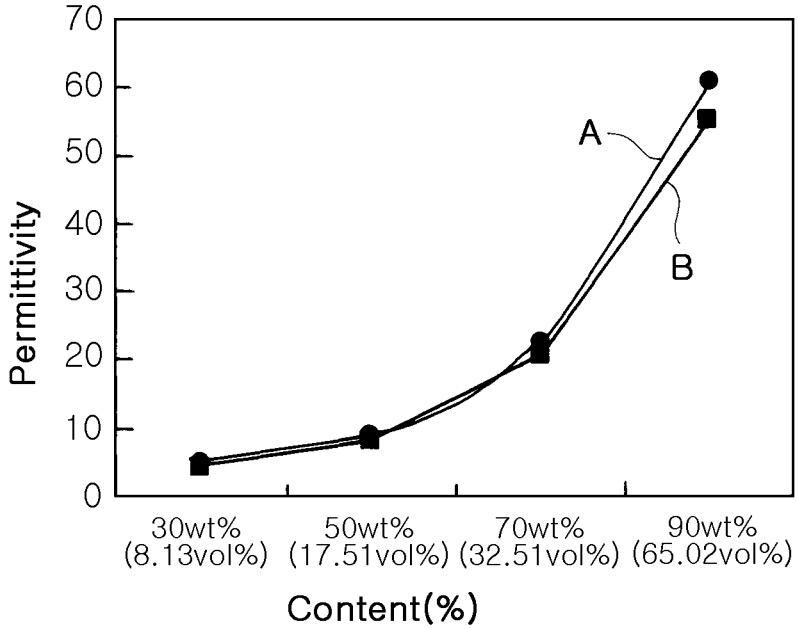
FIG. 4 is a graph for explaining efficiency of an antenna manufactured according to the present invention.

FIG. 4 is a graph showing an antenna manufactured by the method for manufacturing an antenna according to the present invention. The graph of FIG. 4 shows a relative permittivity with respect to the content of the composite material contained in the molding material. In the graph of FIG. 4, curve A represents the relative permittivity measured at a frequency of 1 kHz, and curve B represents the relative permittivity measured at a frequency of 1 MHz. It can be seen from the curves A and B of FIG. 4 that the relative permittivity increases up to 60 in proportion to the content of the composite material.

Thus, a miniaturized antenna manufactured by covering a radiator with a molding material having a high relative permittivity and a low-loss characteristic can be mounted inside a mobile communication terminal to be used in a UHF band or a lower frequency band.

Accordingly, an antenna including a radiator covered with a molding material having a high permittivity and a low loss characteristic can be provided, so that a high integration density required in a miniaturized antenna can be achieved, and deformation of a radiator caused by external pressure generated during processes can be prevented.

While the present invention has been shown and described in connection with the exemplary embodiments, it will be apparent to those skilled in the art that modifications and variations can be made without departing from the spirit and scope of the invention as defined by the appended claims.

What is claimed is:

1. A method of manufacturing an antenna, the method comprising:

forming and preparing a radiator for the antenna;

mounting the radiator inside a dam molding part including an upper dam molding part and a lower dam molding part, a first end of the radiator passing through and positioned outside the dam molding part;

injecting a molding material into the dam molding part through an inlet provided at one side of the dam molding part, the molding material including a composite material with a controlled diameter and content;

hardening the injected molding material; and separating the hardened molding material covering the radiator from the dam molding part, wherein in the injecting the molding material into the dam molding part, the molding material is a material having a relative permittivity ranging from approximately 20 to approximately 60, and the composite material includes one of $BaO—TiO_2$, $(Mg, Ca)TiO_3$, $BaO—Nd_2O_3—TiO_2$, $Ba(Mg, Ta)O_3$, $Ba(Zn, Ta)O_3$ and $(Zr, Sn)TiO_4$, which is mixed at a content ranging from approximately 40 wt% to approximately 90 wt% with respect to a polymer material selected from the group consisting of epoxy, acetyl, polystyrol, polyester and polyethylene.

2. The method of claim 1, wherein the radiator is one of a helical radiator, a monopole, a dipole, a planar inverted-F antenna (PIFA), a meander line, a loop radiator and a fractal radiator.

3. The method of claim 1, wherein the mounting the radiator inside the dam molding part comprises:

drawing the first end of the radiator out from the inlet of the upper dam molding part;

inserting a second end of the radiator in a leakage preventing member and mounting the second end of the radiator to the lower dam molding part; and coupling the upper dam molding part with the lower dam molding part to form the dam molding part in which the radiator is mounted at a central portion.

4. The method of claim 3, wherein the mounting the radiator inside the dam molding part further comprises:

applying a release agent to an upper inner groove of the upper dam molding part and a lower inner groove of the lower dam molding part corresponding to the upper inner groove.

5. The method of claim 1, wherein the composite material has a diameter ranging from approximately 5 μm to approximately 20 μm.

6. The method of claim 1, wherein the molding material includes a solvent and a metallic component selected from the group consisting of Mg, Zn, Ni, Co, Mn and Ca.

7. The method of claim 1, wherein the hardening the injected molding material comprises performing a heat-treatment at a temperature ranging from approximately 25° C. to approximately 200° C. by using a predetermined heating chamber or an ultraviolet ray.

8. The method of claim 1, wherein in the mounting the radiator inside the dam molding part, the upper dam molding part includes an upper inner groove, the inlet penetrating outward from one side of the upper inner groove, and two upper mounting grooves respectively provided at edges of the upper dam molding part such that both ends of the radiator are mounted to the edges of the upper dam molding part, respectively drawn out from the upper mounting grooves, and the lower dam molding part includes a lower inner groove corresponding to the upper inner groove, and two lower mounting grooves respectively corresponding to the two upper mounting grooves, wherein the upper mounting grooves and the lower mounting grooves interlock both ends of the radiator so that the radiator is mounted at a central portion inside the dam molding part.

* * * * *